US008038577B2

(12) United States Patent
McIntosh

(10) Patent No.: US 8,038,577 B2
(45) Date of Patent: Oct. 18, 2011

(54) PERSONAL WORKOUT MANAGEMENT SYSTEM

(76) Inventor: Tim McIntosh, Hockessin, DE (US)

( * ) Notice: Subject to any disclaimer, the term of this patent is extended or adjusted under 35 U.S.C. 154(b) by 0 days.

(21) Appl. No.: 12/419,269

(22) Filed: Apr. 6, 2009

(65) Prior Publication Data

US 2009/0253554 A1 Oct. 8, 2009

Related U.S. Application Data

(60) Provisional application No. 61/042,495, filed on Apr. 4, 2008.

(51) Int. Cl.
*A63B 71/00* (2006.01)

(52) U.S. Cl. ..... 482/4; 482/1; 482/9; 482/901

(58) Field of Classification Search ..... 482/1–9, 482/900–902; 434/247
See application file for complete search history.

(56) References Cited

U.S. PATENT DOCUMENTS

| | | | | |
|---|---|---|---|---|
| 4,495,560 | A * | 1/1985 | Sugimoto et al. | 700/34 |
| 4,828,257 | A * | 5/1989 | Dyer et al. | 482/5 |
| 7,258,666 | B2 | 8/2007 | Brown | |
| 2002/0022551 | A1 * | 2/2002 | Watterson et al. | 482/8 |
| 2005/0010426 | A1 | 1/2005 | Chen et al. | |
| 2005/0086083 | A1 | 4/2005 | Brown | |
| 2006/0287883 | A1 | 12/2006 | Turgiss et al. | |
| 2008/0004904 | A1 | 1/2008 | Tran | |

* cited by examiner

*Primary Examiner* — Glenn Richman
(74) *Attorney, Agent, or Firm* — McCarter & English

(57) ABSTRACT

The invention relates to an interactive exercise management system. The system may be used for improving a workout environment for a specific user or group of users, tracking exercise information, and providing future workout information. The system, and method of using the system, allows for a specific user or group of users to control their workout environmental conditions. The conditions that may be controlled include, but are not limited to, sight, sound, smell and climate.

2 Claims, 4 Drawing Sheets

PERSONAL WORKOUT MANAGEMENT SYSTEM

CROSS REFERENCE TO RELATED APPLICATION

The present application claims the benefit of U.S. Provisional Application Ser. No. 61/042,495, filed Apr. 4, 2008, the disclosure of which is expressly incorporated herein by reference in its entirety.

FIELD OF THE INVENTION

The invention relates to an interactive exercise management system and methods of using said system. More particularly, it relates to a system for improving a workout environment for a specific user or group of users, tracking exercise information, and/or providing future workout information.

BACKGROUND OF THE INVENTION

Medical data shows that regular exercise leads to a healthier life. Despite the availability of gyms and health clubs, many people fail to get a sufficient quantity of exercise. One reason people do not exercise is their workout environment is not ideal.

Gyms and health clubs provide exercise rooms that are temperature/climate controlled, however, they do not provide the individual user or group of users with control over the temperature/climate. Gyms and health clubs also provide TV and music as entertainment options for select exercise equipment, however, they do not provide the individual user or group of users with control over the entertainment options.

There is a need to improve the exercise environments, particularly at gyms and health clubs. The present invention provides for an improved workout environment that may be customized and controlled by each specific user or group of users.

SUMMARY OF THE INVENTION

In one aspect, the invention provides a system for managing an individual's personal workout environment. The invention also allows for a specific user or group of users to control their workout environment conditions. The conditions that may be controlled include, but are not limited to, sight, sound, smell and climate.

In another aspect, the invention provides a method of personal workout management. The invention allows for specific users or group of users to use any facility or device connectable to a server to manage their personal workout. The aspects of the personal workout that may be managed include, but are not limited to, environmental conditions, device settings, workout schedule(s), and biometric and/or health related conditions.

In another aspect, the invention provides entertainment for a specific user or group of users of exercise equipment before, during and after a workout.

In one embodiment the present invention is directed to an exercise management system, comprising a) a data terminal wherein the data terminal can identify at least one user; b) a server in data communication with the data terminal wherein the server stores or has access to personal data about the user; and c) at least one environmental control device in data communication with the server wherein the environmental control device controls at least one environmental condition of the user in accordance with the personal data of the user.

In another embodiment, the present invention is directed to a method of controlling at least one environmental condition of at least one user during an exercise session comprising a) providing a data terminal wherein the data terminal can identify the user; b) providing a server in data communication with the data terminal wherein the server stores or has access to personal data of the user; and c) providing at least one environmental control device in data communication with the server wherein the environmental control device controls the environmental condition of the user in accordance to the personal data of the user.

In another embodiment, the present invention is directed to an apparatus for determining an individual's workout program comprising a) a workout location based unit configured for individual interaction and a microprocessor to facilitate monitoring an individual's workout; b) a server in signal communication with the workout location based unit and configured to receive signals from and transmit signals to said workout location based unit, wherein the transmitted signals include instructions for the workout location based unit. Preferably, the communications uses RF transmissions, wireless transmission, sound transmissions or light transmission.

In another embodiment, the present invention is directed to a method for using a workout program comprising a) monitoring a workout of an individual by using a workout location based unit; b) communicating the workout information of the individual to a server in signal communication with the workout location based unit, c) calculating or identifying the next workout program, wherein the information is communicated to the workout location based unit; and d) receiving instructions from the server for a workout in the workout location based unit. Preferably, calculating includes changing the data in anyway, compressing, producing a visual from it, deriving any type of statistics from it such as but not limited to mean, median, mode, variance, standard deviation, and bell curves.

Finally, the present invention is also directed to a method of purchasing or renting entertainment on exercise machines or stations using the system of the present invention. In one embodiment, the method comprises an account that allows users to buy items on their account to be used or viewed through the account or independently of it and wherein the account allows users to purchase items online or through the exercise equipment and wherein the account could is optionally linked to an email address, a credit card or both

DETAILED DESCRIPTION OF THE INVENTION

Figure 1:
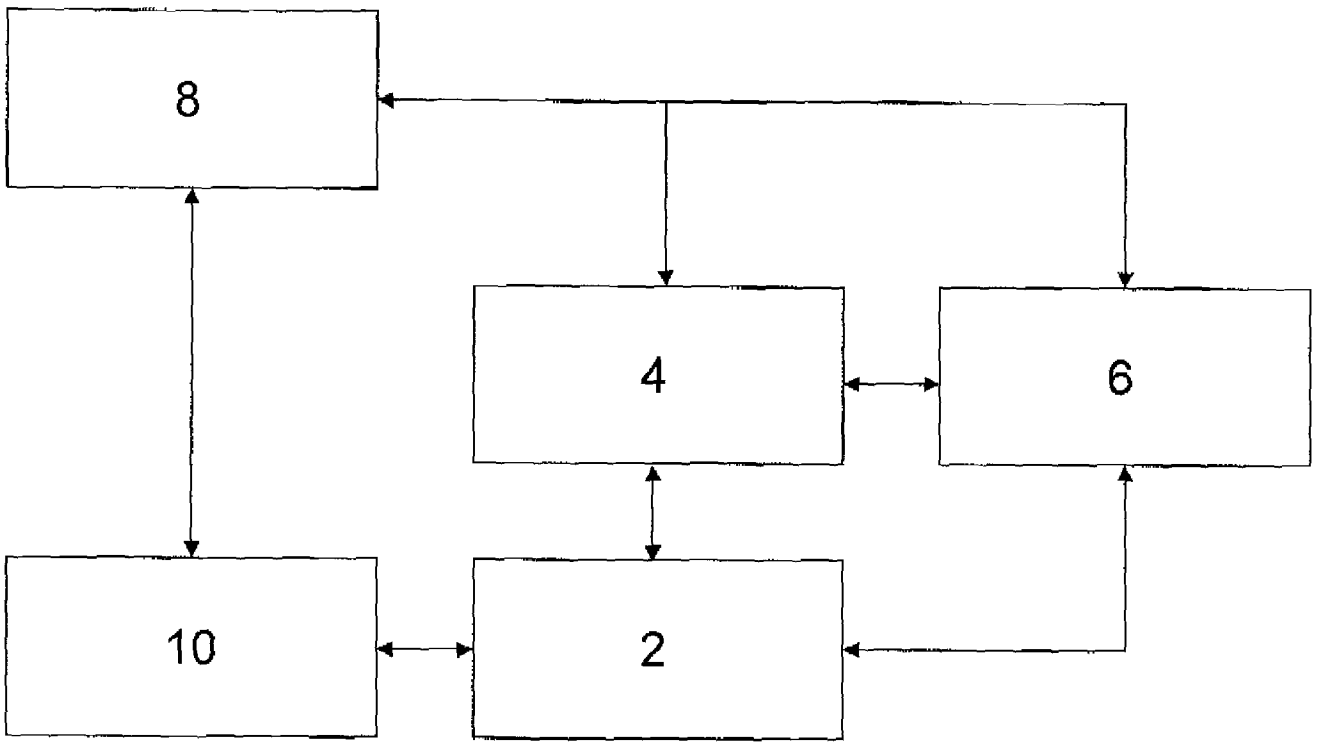
FIG. 1 shows one embodiment of the interactive exercise management system showing the interaction of an exercise equipment/space (2) an audio/visual device (6) as well as a climate control device (10).

A individual's exercise environment greatly impacts the quality of their workout. Altering the environment surrounding a workout can significantly increase or decrease the quality of that workout. The interactive exercise management system of the present invention is intended to manage the environmental conditions of exercise/workout surroundings to improve workout results. The environmental conditions surrounding a particular user or group of users can be altered and continuously updated through a management system by the user throughout the workout session to maximize comfort and enjoyment. Among some of the environmental conditions that may be altered or controlled include sight, lighting, sound, smell and climate.

In one embodiment the present invention is directed to an exercise management system, comprising a) a data terminal wherein the data terminal can identify at least one user; b) a server in data communication with the data terminal wherein the server stores or has access to personal data about the user; and c) at least one environmental control device in data communication with the server wherein the environmental control device controls at least one environmental condition of the user in accordance with the personal data of the user.

In another embodiment, the present invention is directed to a method of controlling at least one environmental condition of at least one user during an exercise session comprising a) providing a data terminal wherein the data terminal can identify the user; b) providing a server in data communication with the data terminal wherein the server stores or has access to personal data of the user; and c) providing at least one environmental control device in data communication with the server wherein the environmental control device controls the environmental condition of the user in accordance to the personal data of the user.

The method may further comprise providing at least one sensor in data communication, directly or indirectly, with the server, wherein the sensor is capable of monitoring the effect of the controlled environmental condition on the user, and wherein the monitored effect is used to modify the environmental control device's control of the environmental condition.

As used herein, the exercise/workout space and the user's environment are used interchangeable. Both refer to the area immediately surrounding an individual user or group of users, or exercise machine(s). An exercise/workout space or user's environment does not extend into another exercise/workout space or user's environment, unless a group of users or exercise machine(s) are intended. For example, a gym may have a group of treadmills arranged in a line, one adjacent to the next, each in use by a separate user. Each treadmill/each user's immediate surroundings define the individual spaces/environments.

The data terminal may comprise a computer, or smaller variations thereof such as a cell phone, Ipod, blackberry or other handheld electronic devices. One function of the data terminal is to serve as an input device to identify users. The data terminal may be a standalone device or an integral part of, or incorporated into, an exercise machine used by the user.

User identification by the system may occur in many ways. For example, the identification of the user may comprise the use of a unique and personal identifier in the form of, for example a password, a finger scanner, a voice recognition device, a biometric identification or card reader, a laser or a magnetic strip, a RFID, a Bluetooth or other wireless means, or a biometric tracker capable of collecting information regarding face structure, fingerprints, hand geometry, keystrokes, hand veins, iris, retinal scan, signature, voice, facial thermograph, odor, DNA or the ear canal.

The data terminal is in data communication with a server. The data terminal, server and other components of the present invention comprise a network. This network may allow data to be transmitted between the data terminal and server, as well as other devices in data communication with either the data terminal or server, such as for example, exercise equipment, sensors, intranets and the internet. The network may either be a closed loop system or an open loop system. The system may be based on standards such as Ethernet, or wirelessly IEEE 802.X.

The user or group of users may store preferences of environmental/workout conditions on the server or externally to the server but accessible by the server. External storage locations of preferences and/or personal data include third party servers, intranets, the internet, computers, and smaller variations thereof such as a cell phone, Ipod, blackberry or other handheld electronic devices. Environmental conditions may include conditions related to sight, sound, smell and climate. For example, preferences may include workout room temperature, body temperature, air supply (e.g. fan or blower speed), ambient light levels, images and intensity of said images, wherein images are preferably displayed on monitors (TV/PC), volume and types of sounds.

Personal data stored on, or accessible by, the server related to the control of the exercise or workout environment includes, but is not limited to, room or air temperature, body temperature, age, sex, weight, height, air flow, lighting, humidity, perspiration, smell, music, heart rate, blood pressure, entertainment preferences, credit card numbers, billing information, membership information, previous workout information, future workout information, goals, milestones, group information and identification numbers. The personal data about the environment may be constant or dynamic (i.e. the setting can change with time or occurrence of an event). For example, the lighting may be low at the beginning of an exercise session, change to high during the middle of session and return to low near the end of the session.

The server may also be used for storing and performing calculations on the environmental and workout information. The server may be permanently connected or connected to the system periodically such as if a runner uses a heart monitor, the heart rate monitor can be connected after the workout to the server for uploading or downloading information. The system may also comprise a transmission system for providing the user or group of users with specific environmental/workout data or calculated environmental/workout information.

The system may also comprise wherein the server includes at least two microprocessors that are located in two different locations that communicate. The servers may communicate through hardlines or wirelessly. The server may include an interface, such as a website, that may be accessed by the identifier and/or the data terminal or other input station. Data may flow freely between the microprocessors.

The environmental control device is preferably designed to provide the environmental conditions require by the user. Some preferred mechanisms include, for example, a fan/blowers, heater, heated floors, mist/sprayer, gaseous mixes, cooler, scent emitters, audio/visual devices, and any other device necessary to produce the desired environmental conditions.

The management system may further comprise at least one audio/visual device in data communication with the terminal wherein the audio/visual device provides visual, audio, or both visual and audio information or entertainment to the at least one user. Examples of audio/visual devices include, but are not limited to, monitors with speakers and TV screens with speakers, computers, projectors, speakers, cell phones, PDAs, video games.

The server may be in data communication with the internet such that the system of the present invention may provide entertainment including, but not limited to, videos, music, advertising, internet access, and games. The entertainment options may be provided by the server, the internet, or a combination of both. In addition, e-commerce may be able to be conducted over the system. Each user or group of users may be identified and an have accounts on the system. For example, a user may use RFID or Bluetooth for automatic user identification by the system when the user uses or approaches the exercise equipment or workout space. Accounts may hold such information as age, sex, previous workouts, workout plans, entertainment uploaded to the account, purchases, and preferences for environmental workout conditions.

For example, entertainment may be provided wherein the sight and sound conditions are altered via the use of speakers to deliver audio input and a monitor to deliver visual input. The sound conditions and light conditions may be altered and/or delivered by using the same audio/visual device or separate audio/visual devices.

The management system of the present invention may also be interactive. The system may track exercise/workout information, including environmental settings, workout settings, biometrics, physiological parameters, and entertainment preferences. The system may monitor these conditions throughout the workout or exercise session and provide continuously updated information or altered environmental conditions. The information may also be used to plan future workouts or exercise sessions and supply future entertainment options.

The management system may further comprise at least one sensor in data communication, directly or indirectly, with the server or network. The sensor should preferably be capable of monitoring an effect of the controlled environmental condition on the user. The monitored effect may be used to modify the environmental control device's control of the environmental condition. For example, the user may prefer to workout on a treadmill without getting overheated. The user's personal data may include a desired body temperature, stored on or accessible by the server, of between 98-99 F. At the beginning of the workout, a body temperature sensor may determine the user's body temperature to be below the temperature range. As such, the sensor/server will communicate to the environmental control device, in this case a heater, to alter the user's environment by making either the exercise/workout space or the user's environment warmer. As the workout progresses and the user's body temperature rises, the sensor may determine the user's body temperature is within the desired temperature range. As such, the sensor/server will communicate to the environmental control device to stop affecting that particular aspect of the user's environment. As the workout progresses further, the user's body temperature may rise such that the sensor may determine the user's body temperature is above the desired temperature range. As such, the sensor/server will communicate to the environmental control device, in this case a cooler, to alter the user's environment by making either the exercise/workout space or the user's environment cooler.

Sensors may include scales, blood sugar monitors/measuring devices, speedometers, heart rate monitors, other medical devices, treadmills, indoor rowing machines, free weights, as well as, computers. Medical devices can include anything that has to do with physical therapy. Personal trainers, whether they be human or electronic, may be able to upload data onto the server/webpage related to the personal data of the user.

In another embodiment of the present invention, the environmental condition that may be controlled is the air content of the exercise/workout space. For example, the air content may be supplemented with oxygen to create an oxygen enriched space. Alternatively, the air content may be deprived of oxygen to create an oxygen deprived space. The air content may be supplemented or enriched with one or more different gases. Further, the space may be supplemented and deprived of the same of different gases during the exercise session to enhance the workout. For example, an oxygen enriched space can be used for a yoga room for a user or group of users. The air content of such a controlled yoga room can comprise a different composition than normal air to improve the performance or outcome of the yoga session.

The invention also allows individuals to control the content, velocity, temperature, and fragrance of air that is moved within a building to allow for a more comfortable environment. This aspect of the invention comprises a facilitation system and a control system. The facilitation system allows for changes in the characteristics of the air that is moved. The second is a control system that manages the facilitation system. The control system may be the same or in communication with the server, i.e. central server.

The facilitation system allows for air to be blown at or near the location of an individual working out. The blown air can be varied in content, velocity, temperature and fragrance and can be varied to different settings for each discrete individual working out as well as during an individual's workout. This variation can be coordinated via the control system to match the individual's workout program. Variations in conditions may be selected or changed by an individual during the workout or matched by pre-selecting the workout and environmental conditions prior to the workout. The control system may monitor an individual using the readouts from the exercise equipment, health monitors used by the individual or other biometric sensors. For example, an individual running on a treadmill and wearing a body temperature sensor may have pre-programmed the control system to blow a high velocity of cold air at or near the individual upon reading an elevated body temperature.

The source of the air can be recycled air, fresh air from outside the workout facility, compressed air or a combination thereof. The content of the air may be supplemented with oxygen, nitrogen, other appropriate gases or fragrances to enhance the workout. Supplemented air contains higher levels of the supplemented gas or fragrance, respectively, compared to normal air to increase their levels in the air at or near the individual working out. For example, a local increase in oxygen levels can simulate sea-level altitudes or make the individual workout easier. A local decrease in oxygen levels (e.g. air supplemented with nitrogen or non-oxygen gas or fragrance) can simulate higher altitudes or make the individual workout harder. The air may also be filtered, sanitized, purified or a combination thereof to enhance the workout. Any filtration, sanitization, or purification system known in the industry may be employed.

The temperature of the air may vary from hot air to cold air. The temperature of the hot air may range from a maximum air temperature of about 100-180° F. or temperatures similar to that of a conventional blow dryer or automobile heating system. The temperature of the cold air may range from a minimum air temperature of about 50-80° F. or temperatures similar to that of a conventional window air conditioning unit or automobile air conditioning system. The velocity of the air may vary from a slight breeze or a strong wind. Air velocities may range from 1-50 mph.

The facilitation system that moves air is similar to a HVAC system. The heating and cooling units can be any conventional heating and cooling systems used for a building or for individual use. The ducts, from which the air is primarily blown from the facilitation system and onto the individual, can be made of metal, plastic or any combination thereof. They can ridged or flexible. The ducts can be in the floor, in the ceiling or suspended in-between. They can be located in a fixed location or adjustable by the individual. The facilitation system can have one or more ducts. For multiple duct systems, the air content, temperature, velocity and fragrance may be varied individually at each duct. The facilitation system is self-adjusting. For example, an individual workout program is designed before the workout, and during the workout, the facilitation system adjusts automatically.

In one embodiment, a duct will be available at each work station where an individual performs part of a workout. Each duct will have the ability to be controlled by the individual either manually or via the control system. For example, a row of 10 treadmills may have one or more ducts for each treadmill. Alternatively, the system could be used in a group room. For example, multiple ducts that could be aimed at each person participating in an aerobics class. In an open format, like an aerobics class or free weight room, the facilitation system can control the air in the room via adjustable zones. The conditions in the zones can be activated by the presence of the individual or individuals using the space. For more than one individual in a space, the control system can either control the environment using one individual's environmental settings or use an average from both individuals or any combination thereof. The adjustable zones may be as small as 3×3 (feet) or as large as 15×15 (feet).

The system may also be able to track where an individual is and adjust the system to follow them with their specific settings. For example, when an individual is running around an indoor track, the system can track and predict, using wireless communications, where the individual is and blow air on specifically on the individual.

The server may also control the treadmill settings and correlate the exercise machine settings with the personal data of the user. The system may also monitor and control the exercise machine settings, including, but not limited to, speed, revolutions per unit of measure, steps per unit of measure, strokes per unit of measure, distance traveled, time, calories burned, watts, mets, incline, resistance, drag, weight, and repetitions.

The system may comprise one or more sensors. The sensor may be any sensor having the ability to monitor an effect of environmental change on the user or user's environment. Preferably, the sensor comprises a visual sensor, an infrared sensor, a temperature sensor, a biometric sensor or combinations thereof. Examples of sensors, include, but are not limited to, thermometers, heat sensors, wind sensors, moisture sensors, gas content sensors, heart monitors, weight, blood pressure monitor, body temperature, pulse or heart rate, blood pressure, respiratory rate, pupil size, body mass index, urinary continence, end-tidal $CO_2$, spirometry, glucose levels, intracranial pressure, skin signs (color), hemoglobin and iron levels, arterial blood gas levels, bilirubin and electrolytes, and lactate, along with other medical or physical therapy measurements.

The system may also be configured such that the terminal is in data communication with an exercise machine, and wherein the exercise machine comprises at least one sensor. Examples of exercise machines include, but are not limited to, treadmill, elliptical, stair stepper, stationary bike, indoor rowing machine, indoor skier, cross trainer, and any other form of cardio trainer. The exercise machine may also be a strength machine such as free weight and plate systems. It may also be a GPS and/or heart rate monitor as well as any other type of machine typically used in health clubs and gyms.

FIG. 1 shows one embodiment of the interactive exercise management system. An exercise equipment/space (2) is in data communication with a data terminal (4). The data terminal (4) is in data communication with an audio/visual device (6) as well as a server (8). The audio/visual device is in data communication with the server (8). The server (8) is also in data communication with a climate control device (10). Finally, the exercise equipment (2) may be in communication with the audio/visual device (6) and the climate control device (10).

Figure 2:
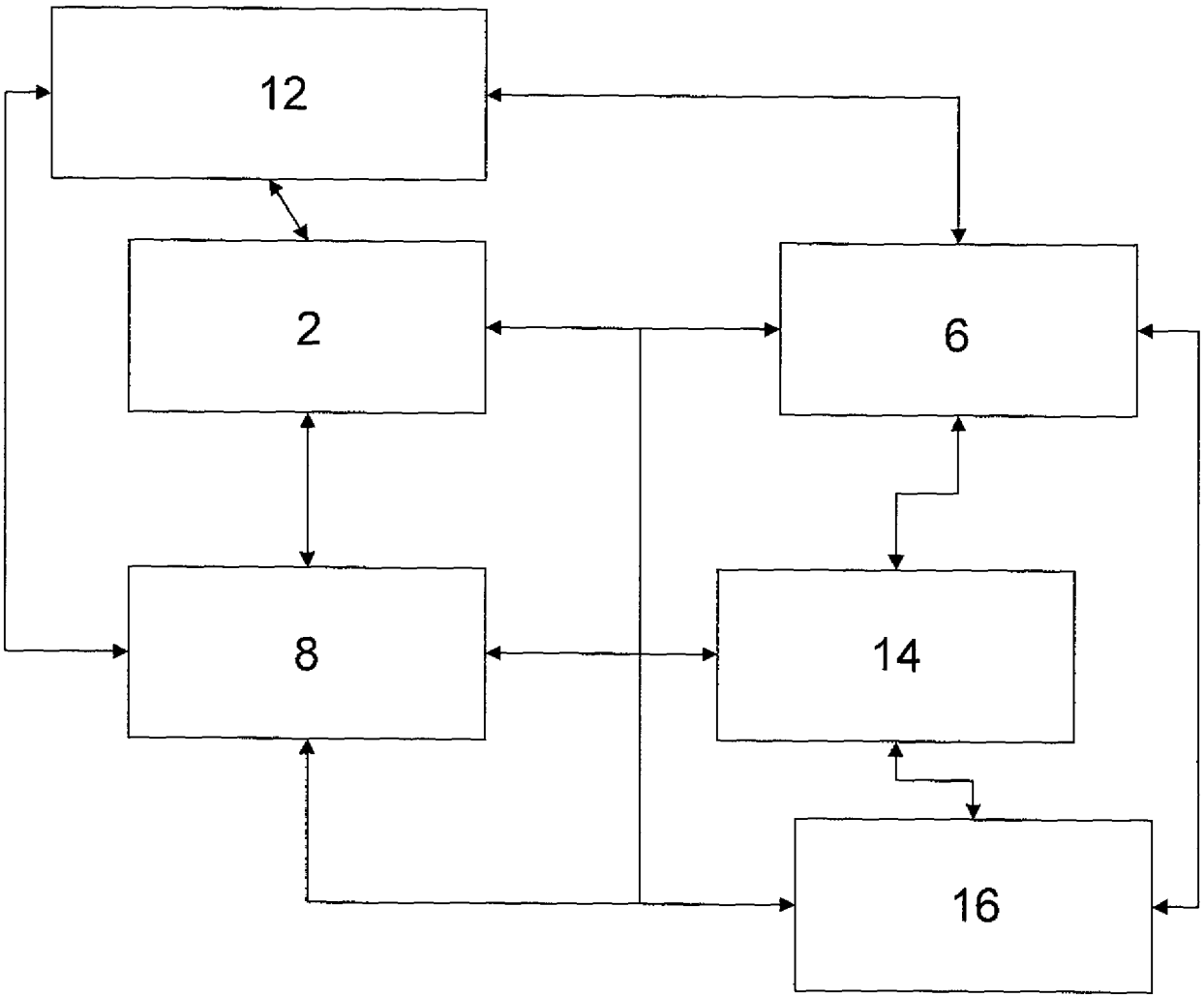
FIG. 2 shows one embodiment of the system showing the interaction of the server (8) with a third party server (12), an intranet (14) and the internet (16).

FIG. 2 shows another embodiment of the system. An exercise equipment/space (2), a server (8), the internet (16), an intranet (14) and an audio/visual device (6) are all in data communication. A third party server (18) is in data communication with the server (8), the exercise equipment/space (2) and the audio/visual device (6).

Figure 3:
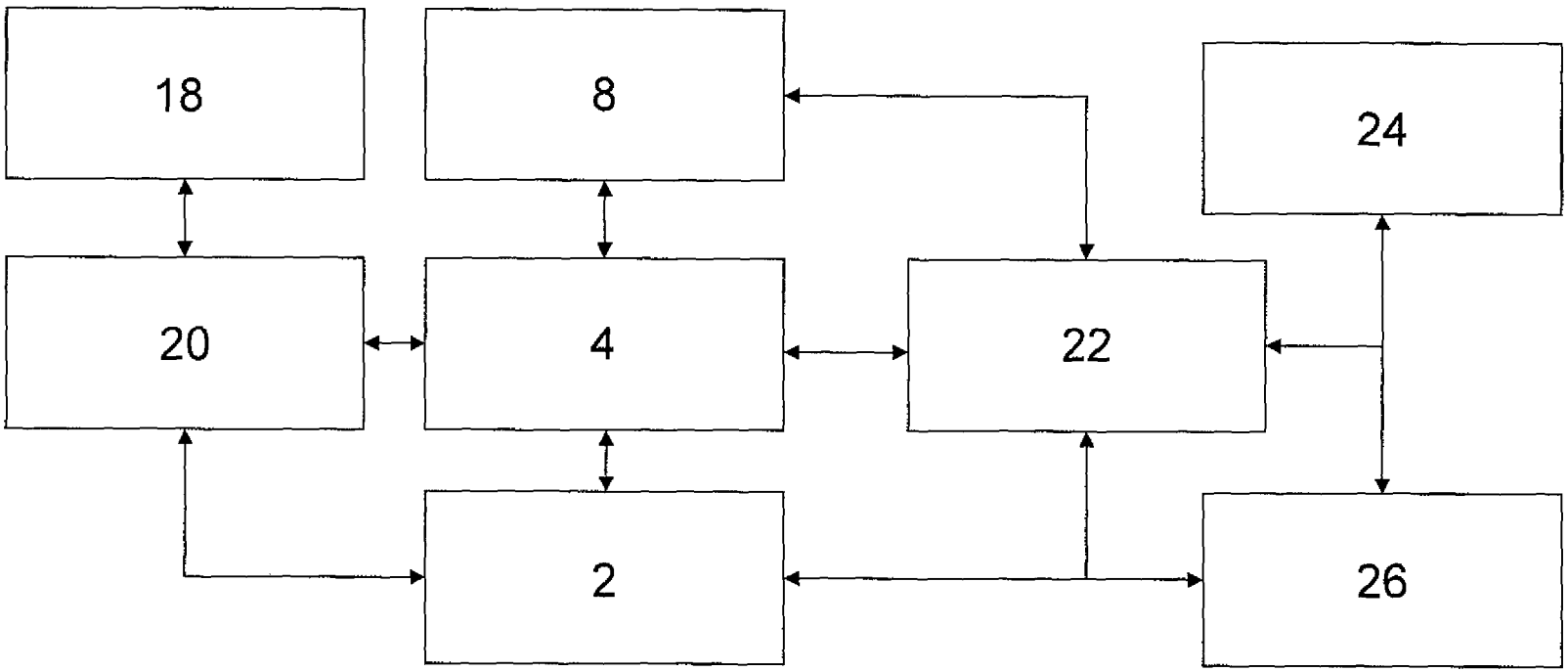
FIG. 3 shows one embodiment of the system showing the interaction of the data terminal (4) with a user (18), user account (22) and entertainment/advertising (24 and 26).

FIG. 3 shows another embodiment of the system. A user (18) is identified by the system using an user identifier (20). The user identifier (20) is in data communication with a data terminal (4) and an exercise equipment/space (2). A user account (22) is in data communication with the data terminal (4) as well as entertainment (24) and advertising (26). The entertainment (24) and advertising (26) may be in data communication with the user (18) and/or exercise/equipment space (2) directly or via one or more audio/visual devices (not shown).

Figure 4:
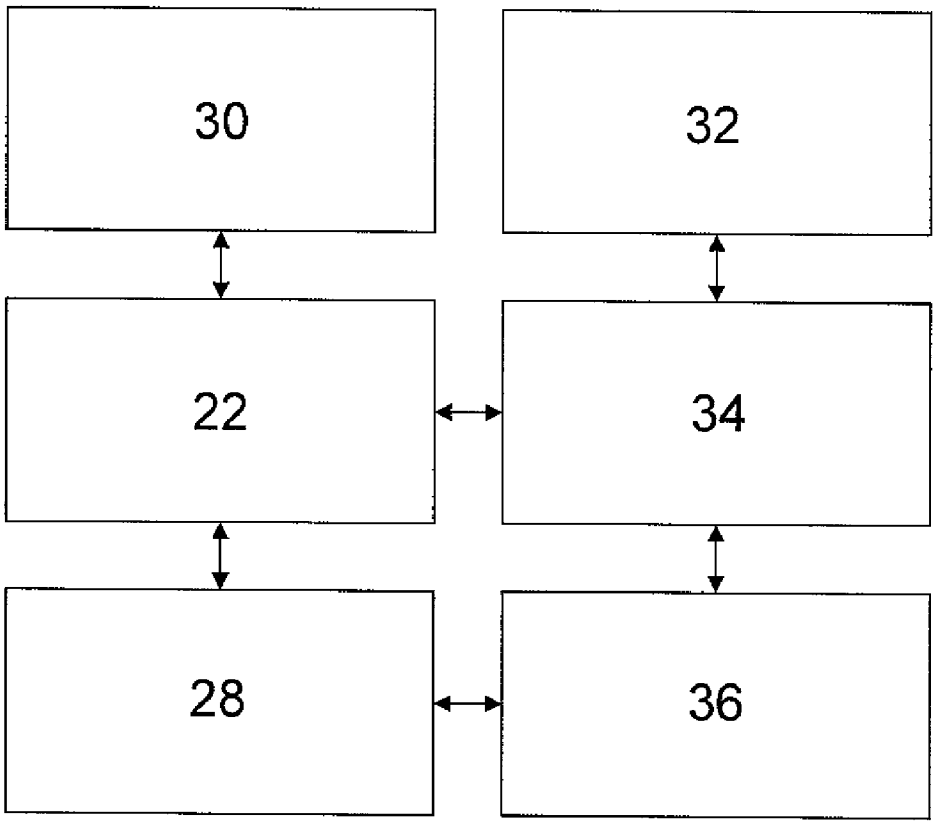
FIG. 4 shows one embodiment of the system showing the interaction of the user account (22) with the users previous (30) and current (32) workouts and preferences (34), and the electronic media (36).

FIG. 4 shows another embodiment of the system. A user account (22) is used to access the user's preferences (32) for the present workout parameters and conditions (32) and general media (36), including advertising and entertainment. The user account can be used for making purchases (28) from the media (36) and to track previous workouts (30).

In another aspect of the present invention, the system may also provide a method of personal workout management such that a user or group of users have the ability to go anywhere and use any exercise equipment and have preferred environmental conditions or have their workout data recorded to an external site that can be accessed anywhere in the world.

The invention allows a user or group of users the ability to use any exercise equipment, such as strength or cardio training equipment, heart rate monitors or electronic personal trainers, and have the workout data and/or personal data collected from that equipment and made available anywhere in the world via the internet or some other form of remote access. This information can be made available in many forms, such as data, graph, chart, etc. The invention is designed to help the individual maximize each and every workout, plan optimal workout and environmental conditions and allow for goals to be inputted, accessed, tracked and more readily obtained than without the monitoring system.

In another embodiment, the system comprises a network of input devices, identifiers, measuring devices and a server. Separate facilities can be designed to incorporate these components. Individual users may be able to access their information from these facilities thus providing the ability to exercise efficiently at many different locations. For example, locations A and B, with treadmill models C and D respectively, may be equipped with the components of the invention. An individual can workout on treadmill C at location A and then treadmill D and location B and have all the data uploaded and available on a server or central server. The server may contain programs and/or calculations to help the individual evaluate the first workout and provide a program or recommendation for the next workout, even if the next workout is performed at a different location than the first. Optionally, the locations A and B may be equipped with environmental control devices and sensors. The environmental control settings and the sensors may be correlated to the workout information to plan more effective workout programs.

The input/data terminal and measuring devices may all be contained in the same piece of equipment. The input device may be contained within the measuring device, such as a treadmill with a microprocessor connected up to the internet. The input device and measuring device may be discrete or different devices. For example, the input device may be a cell phone and the measuring device a heart monitor. After an individual has run outside wearing the heart monitor, the monitor information may be uploaded via the cell phone to the server. The next workout information can be then accessed from the server and downloaded to the cell phone Data input into the network or system may come from devices located all over the world. Preferably, the data input is provide by the user, the sensor, the identifier and/or the exercise machine. The exercise systems of the present invention may be at gyms/fitness centers, community centers, schools, hotels, corporations or with individual users. Gyms/fitness centers include both public and private, as well as, small and large. Communities include both government run and community run. Schools include secondary schools, colleges and universities. Hotels include both public resorts and private resorts, as well as, small and large. Corporations include both public and private, as well as, small and large.

In another embodiment, the invention comprises individual accounts for individual users. Each account may represent the individual's section of the central server that stores and processes the individual's information or personal data, such as workout results. The server account may act as the interface to the input and measuring devices.

The account may store a myriad of information. One purpose of the data storage is to help individuals train better. To accomplish this, the account can keep track of data, such as, environmental conditions, calories burned, distance traveled, speed and heart rate. The data may be collected from any type of fitness machine that is capable of uploading data to the server or transferring data to the data terminal. These can be, but are not limited to, treadmills, elliptical, scales and heart rate monitors. After these machines upload the data, the data may be available on the individual's account. The data may be viewed from many locations, such as, but not limited to, computers and cell phones.

Another use of the system is store interactive data to provide the ability to plan interactive workout. For example, individuals can complete sections of workout plans to meet goals or to train for a specific competition. Additionally the interactive data can be used to help lose weight. This feature, like others, may be viewed from many locations, such as, but not limited to, computers and cell phones.

The account may also be used by users to buy items to be used or viewed through the network. The account may allow users to purchase items online through the network, data terminal, and/or exercise machine. The account may also be linked to an email address and/or a credit card. Examples of items that may be purchased include music, videos, virtual magazines, virtual books, workout plans, weight loss plans, sports gear and workout gear. Movies may include full length, motivational, TV series and music videos. Music may include songs, books on tapes, pod casts and recordings. Workout plans may consist of any type of plan that is meant to alter the condition of the user. Weight loss plans may include any plan that is meant to alter the user's weight, percentage of body fat, etc. Weight loss and work out plans can be endorsed by, and purchased from, separate companies, even celebrities. Weight loss companies may encourage the use of certain plans for people trying to lose weight, and other plans for people training for a specific competition. All of these products are available to motivate or help improve the users workout.

The system may be connected to the internet to send/receive data. Preferably, integrated and approved apparatus or websites can have access to the network, server and or webpage. Access may be controlled by an electronic signature. Means of data transfer will depend on the make and model of the apparatus. Data transfer may occur wirelessly via an external server or computer to the network/server, or via wires to an external server or computer to the network/server. Data transfer may also occur by directly uploading, for example by a disk drive, flash drive or CD, directly to the network/server data transfer may occur before, during or after the exercise session.

Data transferred using the network may be all different kinds of data. Data may include environmental conditions or effects thereof via sensors, calories burned, speed traveled, distance traveled, rpms, incline, power level, preset programs, weight, repetitions, time, etc. The data may be recorded at every change possible. For example, if the rpm changes from 90.0000 to 90.0001 this will be recorded. There is no set percentage of change that will trigger a recording for a specific data point. Each data terminal or sensor may record data according to appropriate standards, and then upload the data during or after the completion of the workout.

Individual components of the system of the present invention may also include an input/output device, such as a touch screen monitor, attached to or located near an exercise equipment or workout space. The system may also comprise a monitor, a hard drive, a Wi-Fi, a RFID reader, speakers, a headphone jack, an audio input, an audio output, a video input, a video output, and/or ethernet connections.

Data output includes physical and non-physical. Physical output may resembles a paper print-out. Non-physical output includes, but is not limited to, remote access/website and the environmental control device, audio/visual display device, and the exercise machine. The website may provide information in any form including, graphs, timelines, charts, raw data and workout plans.

The facilitation system can be controlled by an individual during the workout, manually or by using an interface in communication with the control system, or controlled by a pre-determined program set up prior to when the workout beings. The facilitation system can be in constant or intermittent communication with the control system. The control system may send directions to the facilitation system to control its operation. The control system can be designed to control the workout and environmental conditions from all fitness zones and machine stations.

The control system may be in communication (via hardwire, wireless, computer, internet, Ipods, Iphones, cellphone as well as other standard communication means) with the individual. The individual can program the control system to control the environment in conjunction with a workout or change the environment during the workout. The individual can communicate with the control system to initiate the workout program and environmental conditions. Alternatively, the individual may be outfitted with a location device that is in wireless communication with the control system. The control system can then monitor when and where the individual is and control the environment accordingly.

The control system and the server or central server, which controls the individual's workout, may be separate systems or the same system. The environment can be controlled and varied by the control system to match the workout program.

What is claimed is:

1. A method of controlling at least one environmental condition of at least one user during an exercise session comprising:

a) providing a data terminal wherein the data terminal can identify the user;

b) providing a server in data communication with the data terminal wherein the server stores or has access to personal data about the user;

c) providing at least one environmental control device in data communication with the server wherein the environmental control device controls the environment condition of the user in accordance with the personal data of the user, and d) providing at least one sensor in data communication with the server, wherein the sensor is capable of monitoring and predicting a user's location, and wherein the environmental control devise controls the environmental condition of the user as the user changes locations.

2. The method of claim 1, wherein the user's location is on an indoor track, and wherein the environmental control devise controls the environmental condition of the user as the user changes locations on the indoor track.

* * * * *